US007810506B2

(12) United States Patent
Munoz et al.

(10) Patent No.: US 7,810,506 B2
(45) Date of Patent: Oct. 12, 2010

(54) APPARATUS AND METHOD FOR DELAMINATING PARCELS OF TOBACCO

(75) Inventors: Carlos Munoz, Lausanne (CH); Roger Spry, Hampshire (GB); Michael Lauenstein, Cormondrèche (CH)

(73) Assignee: Philip Morris USA Inc., Richmond, VA (US)

( * ) Notice: Subject to any disclaimer, the term of this patent is extended or adjusted under 35 U.S.C. 154(b) by 798 days.

(21) Appl. No.: 10/476,301

(22) PCT Filed: May 2, 2002

(86) PCT No.: PCT/EP02/04810

§ 371 (c)(1),
(2), (4) Date: Jan. 27, 2004

(87) PCT Pub. No.: WO02/089614

PCT Pub. Date: Nov. 14, 2002

(65) Prior Publication Data

US 2004/0129282 A1 Jul. 8, 2004

(30) Foreign Application Priority Data

May 4, 2001 (EP) ..... 01110156

(51) Int. Cl.
*A24B 1/10* (2006.01)

(52) U.S. Cl. ..... 131/327

(58) Field of Classification Search ..... 131/189.1
See application file for complete search history.

(56) References Cited

U.S. PATENT DOCUMENTS

| | | | |
|---|---|---|---|
| 4,361,749 | A | 11/1982 | Lord |
| 4,532,946 | A | 8/1985 | King, Jr. |
| 4,565,601 | A | 1/1986 | Kakehi et al. |
| 4,597,396 | A | 7/1986 | Holt et al. |
| 4,971,653 | A | 11/1990 | Powell et al. |
| 5,186,238 | A | 2/1993 | Del Puerto et al. |
| 5,192,849 | A | 3/1993 | Moslehi |
| 5,835,334 | A | 11/1998 | Barnes et al. |
| 6,392,205 | B1 | 5/2002 | Minonishi |

FOREIGN PATENT DOCUMENTS

| | | | |
|---|---|---|---|
| EP | 0 244 138 | A | 11/1987 |
| EP | 0357424 | A | 3/1990 |
| JP | 59136930 | A | 8/1984 |
| JP | 59175727 | A | 10/1984 |
| JP | 60206050 | A | 10/1985 |
| JP | 02146728 | A | 6/1990 |
| JP | 03190125 | A | 8/1991 |
| JP | 07130830 | A | 5/1995 |
| JP | 09036097 | A | 2/1997 |
| WO | 01/24581 | A | 4/2001 |

OTHER PUBLICATIONS

Notification of Transmittal of the International Search Report and the Written Opinion of the International Searching Authority or the Declaration for PCT/US2004/009626 dated Apr. 14, 2005.
Hungarian Search Report Dated Oct. 27, 2005 for Hungarian Application No. P0400728.
Bela, Gyorivanyi, "A Cigaretta-Gyartas", Mezogasdasagi Kiado, Budapest, 1986.

*Primary Examiner*—Philip C Tucker
*Assistant Examiner*—Michael J Felton
(74) *Attorney, Agent, or Firm*—Buchanan Ingersoll & Rooney PC

(57) ABSTRACT

The apparatus and method for delaminating tobacco in the form of slices from a layered parcel (10) comprise conveyor means (16) for delivering a parcel (10) of tobacco to a separating location (20) and a rotatable tine assembly (32) mounted on an axis (24) extending at right angle to the conveyor means (16) and parallel the layering of the parcel (10). The rotatable tine assembly (32) includes a plurality of tines (26) which are pointed and profiled to extend in the direction of rotation of the tine assembly (32) and are driven at a speed greater than that of the conveyor means (10). The tines (26) are adapted to enter the parcel (10) at an entering location (34) in a direction substantially parallel to the layering of the parcel (10) and to accelerate a layer (36) away from the parcel (10) for effecting separation of the layer (36) of tobacco from the parcel (10). The axis of the tine assembly (32) is arranged at a distance above the parcel (10) such that the line from the axis of the tine assembly (32) to the entering location (34) forms an angle between 14 and 24 with the horizontal and the peripheral speed of the tine assembly (32) is about three to five times the linear speed of the conveyor means (16).

23 Claims, 5 Drawing Sheets

APPARATUS AND METHOD FOR DELAMINATING PARCELS OF TOBACCO

This application is a national stage application under 35 USC §371 of International Application Number PCT/EP02/04810, filed May 2, 2002, the international Application being published in English. This application also claims priority under 35 USC §119 to EP 01110156.5, filed May 4, 2001.

DESCRIPTION

This invention relates to an apparatus for delaminating tobacco in the form of slices or layers from a layered parcel of tobacco. The apparatus comprises conveyor means for delivering a parcel of tobacco to a separating location, a rotatable tine assembly mounted on an axis extending at a right angle to the conveyor means and parallel to the layering of the parcel and including a plurality of tines which are pointed and profiled to at least partly extend in the direction of rotation of the tine assembly and are driven at a speed greater than that of the conveyor means, the tines being adapted to enter the parcel at an entering location in a direction substantially parallel to the layering of the parcel and to accelerate a layer away from the parcel for effecting separation of the layer of tobacco from the parcel.

Tobacco is supplied to cigarette manufacturers in the form of parcels. These parcels are usually layered due to the tobacco, leaves having been laid flat one on top of each other and subsequently compressed. These parcels will be separated into slices or layers prior to conditioning of the tobacco in continuous conditioning cylinders. The problem with separating out these parcels is that considerable degradation of the tobacco leaves often results.

EP-A-0 244 138 discloses a tobacco delaminating apparatus as outlined above wherein one or two rotatable tine assemblies can be provided at the separating location. One tine assembly is arranged below the layer parcel of tobacco and the other above the parcel in the embodiment with two rotatable tine assemblies. The rotatable tine assemblies may be driven at any speed greater than that of the conveyor or not driven at all. Two designs are disclosed for the tines: The tines are continuously curved in the first design and angled in the second. The tines have an inner radial part and an outer part arranged at an angle of about 45° to the radius in the second design. At least the edge portions of the tobacco lamina are deformed or crushed when separated by the tines.

The problem underlying the invention resides in how to separate slices or layers of tobacco form parcels of tobacco in such a manner as to avoid substantial degradation of the tobacco leaves.

That problem is solved according to the invention by the axis of the tine assembly being arranged at a distance above the parcel such that the line from the axis of the tine assembly to the entering location forms an angle between 14 and 24°, preferably about 16°, with the horizontal and by the peripheral speed of the tine assembly being about three to five times the linear speed of the conveyor means.

The rotatable tine assembly comprises preferably a shaft on which the plurality of tines is mounted in a star-like configuration with equal angular distance between the tines. The tines comprise a support arm having an inner part extending radially from the shaft and an outer part extending almost tangentially, there being a smooth transition between the inner and the outer parts.

A blade is mounted at the tip of the outer part. The blade preferably has a width of 100 to 200 mm in axial direction and a height of about 50 mm in tangential direction. The blade moves vertically into the laminations at a speed having a horizontal component coincident with the movement of the tobacco parcel. The blade is not sharp. Its tip has a radius of a few millimeters so that it is prising the tobacco rather cutting. It propagates the natural lamination. The blade facilitates prising apart the slices and enters the tobacco parcel causing prising to occur. The blade may be regarded as the primary active area of the tine. The rest of the outer part is designed such that it does non interfere with the tobacco.

The tines arranged star-like on the shaft look like a paddle wheel. The shaft carries preferably a plurality of such paddle wheels, the blades being aligned.

The conveyor means may comprise a conveyor belt for delivering the parcel to the separating location. Means may be provided for tipping a parcel of tobacco onto the conveyor such that the layering is generally at right angles to the conveyor.

Tobacco parcels range from Oriental Bales at 25 to 100 kg through C-48 cartons at 160 to 200 kg and through to hogsheads at 400 to 450 kg. Since the material is delaminated with the laminations vertical, the structural integrity of the tobacco to be delaminated has to be taken into consideration such that the delamination range may be 25-50 mm on oriental bales, 40-80 mm on C-48 cartons and 100-200 mm on hogsheads. C-48 cartons have a dimension of 0.72 m in the direction of lamination and hogsheads have a diameter of 1.2 m so that the height of those parcels is 0.72 m and, resp., 1.2 m when laying on the conveyor belt where the lamination is vertical. Prepackaged tobacco other than reconstituted tobacco and preblended materials are packed in C-48 cartons. Depending on the tobacco type and flow rate, different designs of tines will be used, but the fundamental requirements are similar and comply with the following:

- The tobacco parcel moves towards the delamination tines with the laminations oriented vertical and normal to the direction of travel.
- The tine enters the tobacco parcel with its tip vertical.
- The shape of the tines and the peripheral speed of the tine assembly permits initial movement of the tine tips when entering the parcel in order to be coincident with the horizontal movement of the tobacco.
- The shape of the tine back following initial penetration is such that its point of contact with the parcel moves in horizontal direction at about the conveyor speed without interfering.
- The horizontal velocity component of the tine accelerates during the delamination phase up to where the separation of the slice started during the initial prising is completed.
- As the rotation of the tine assembly continues, the horizontal component of the tine velocity increases up to about 3 to 5 times the horizontal velocity of the tobacco parcel.
- The delaminated slice is contained in a pocket between adjacent tines, a leading tine and a trailing tine, until the leading tine raises sufficient to permit the slice to be released.
- The pocket must be larger at the height of the tobacco parcel than the slice to be delaminated.

As the delaminating device processes only one tobacco parcel at a time, the tines are "parked" in an open pocket position permitting the parcel to be introduced into the mechanism. In the "parked" position the paddle wheel is awaiting the arrival of the parcel with one of the tines a short distance above the separating location. This facilitates equal delamination sections to be generated and within a time interval that allows mass flow capability.

The shape, size and number of tines are selected dependent on the tobacco type, density and delamination thickness, but in all cases the pocket between the tines is able to accommodate the delaminated slice. The larger is the parcel, the larger are the tines and the fewer tines are required.

The preceding or leading tine is used to control the release of the delaminated section to ensure consistent feed to the next phase of the process.

The tobacco parcel is not held by the following tine during the delaminating process as the new concept has low distorting forces and allows for tobacco parcel stability.

The apparatus according to the invention is particular advantageous in view of its ability to delaminate the parcels into small, equal sized slices. The delaminating apparatus is immediately followed in the tobacco processing by a continuous conditioning cylinder in which the dry tobacco is heated and humidified. It is this process that protects the tobacco during subsequent processing. In order to optimize this process it is essential that small, equal sized portions are feed into the conditioning cylinder. That low mass flow variation enables the process to achieve low temperature standard deviation and low moisture standard deviation.

The apparatus according to the invention is able to improve conditioning performance as the slices are typically 15%-30% of the weight of slices presently generated horizontal and vertical slices, thus producing significantly greater number of slices for a given mass throughput. This improved input control substantially reduces the incidence of pads (unconditioned tobacco) exiting the conditioning cylinder.

In order for optimal delamination to occur it is preferred that certain geometric relationship are maintained for the penetration ratio, the prising ratio and the delamination ratio. The penetration ratio is the relationship between the final depth of penetration and height of the tobacco parcel. It should be in the range of 15%-50%, preferably 18%-30%.

The prising ratio is the relationship between the cumulative width of the blade tip and the tobacco parcel width. It should be in the range of 20%-50%, preferably 25%-30% The delamination ratio is the relationship between the delamination thickness of the parcel and the height of the tobacco parcel. It should be within the range of 4%-40%, preferably 6%-17%.

An embodiment of the present invention will now be described with reference to the accompanying drawing in which.

Figure 1:
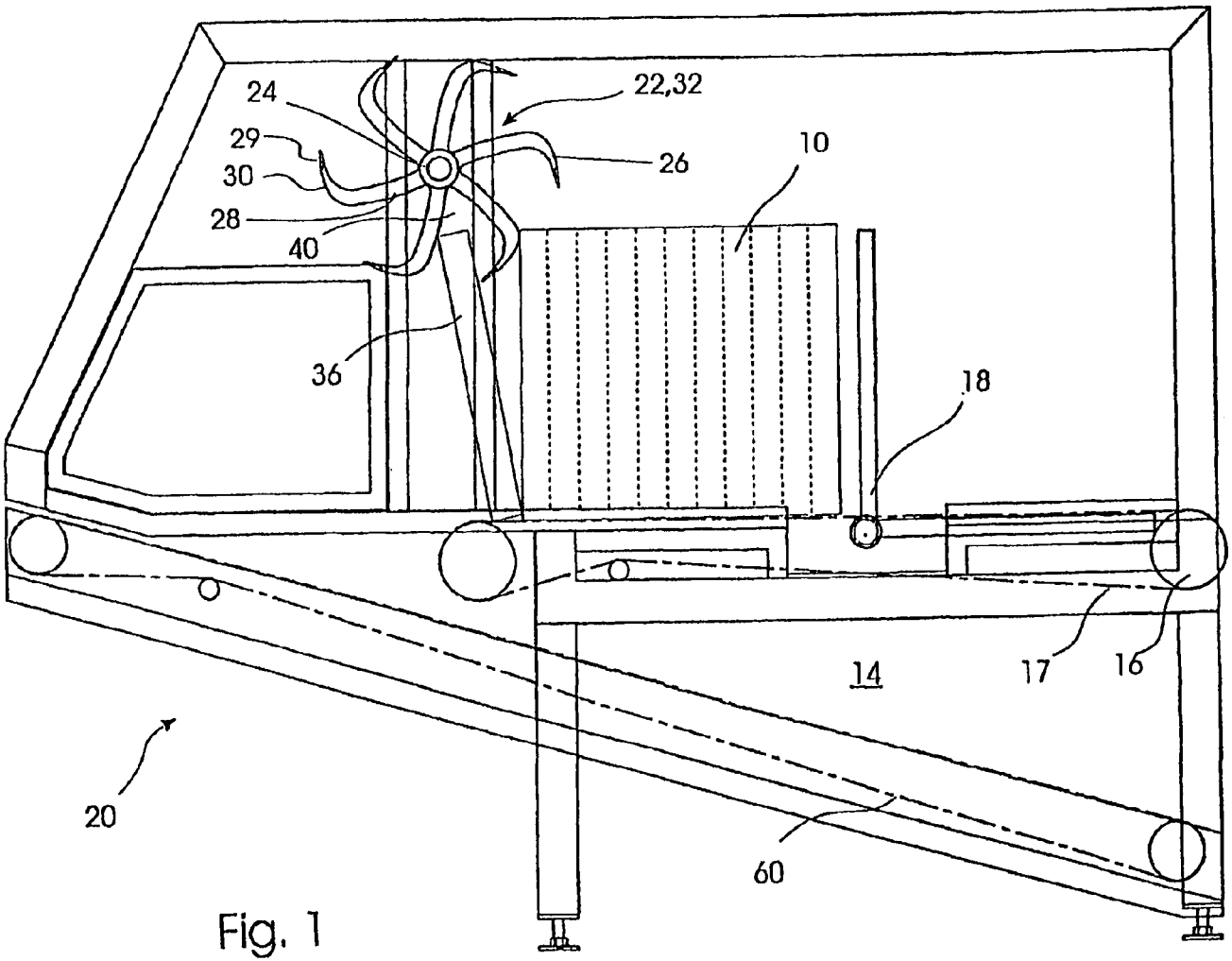
FIG. 1 is a side view of a delaminating apparatus according to one embodiment of the invention.

Referring to the drawings, tobacco parcels 10 are transported by a conveyor means 14 which includes a conveyor 16 comprising an endless belt 17. Each parcel 10 is comprised of substantially parallel, stacked layers of tobacco leaves. A tipper unit 18 is provided at the inlet end of the conveyor 16 for tipping over parcels 10 having a horizontal layering so that all parcels 10 transported on the conveyor 16 have a vertical layering.

The parcels 10 are carried successively on the conveyor 16 to a separating location 20 adjacent a separating device 22. The separating device 22 comprises a shaft 24 extending substantially horizontal and at right angles to the direction of movement of the conveyor 16. The shaft 24 is positioned at such a height above the conveyor 16 that the parcels 10 can move on the conveyor 16 below the shaft 24.

Figure 2:
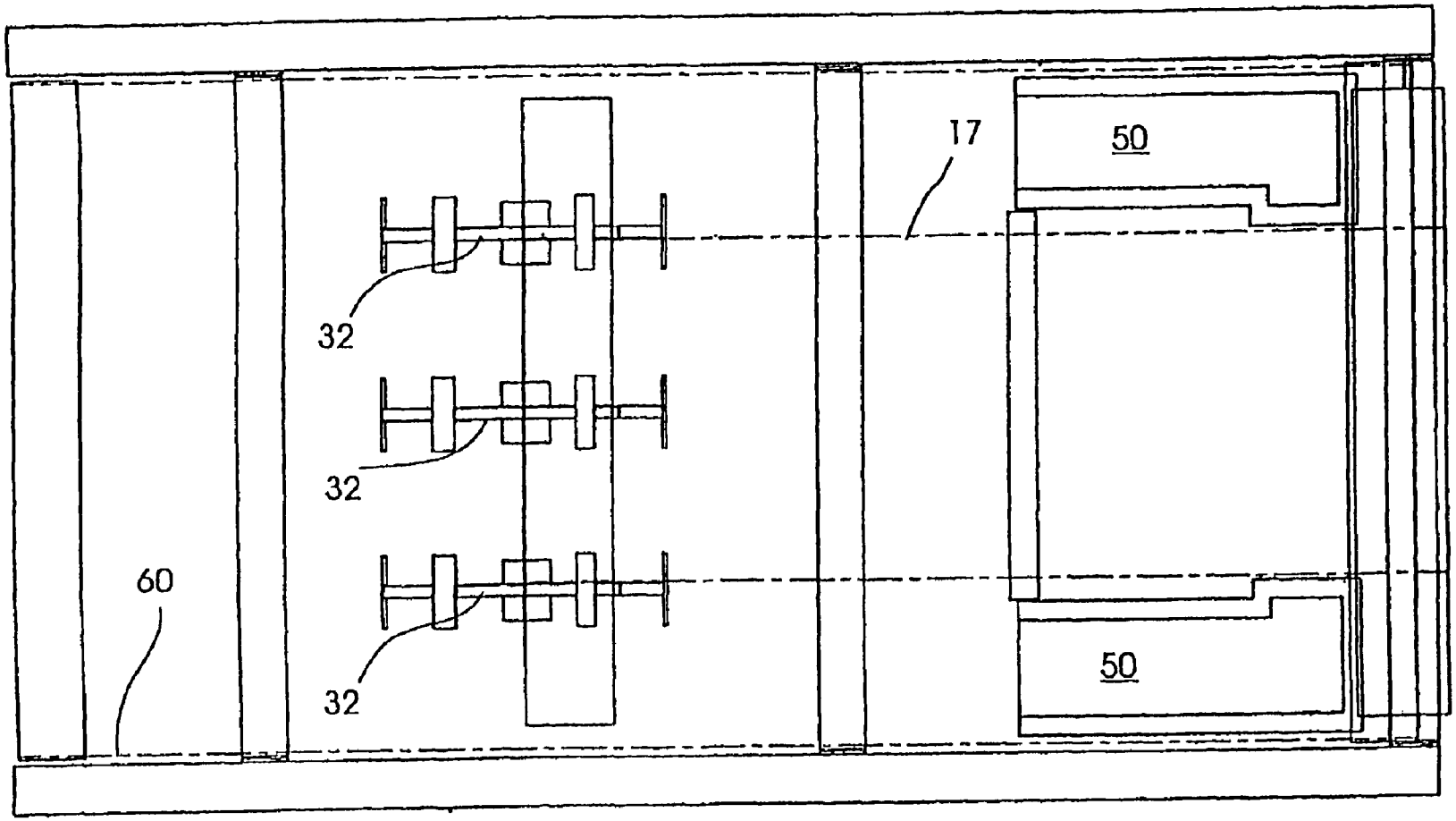
FIG. 2 is a plan view of the apparatus of FIG. 1.

The shaft 24 mounts a plurality of tines 26. Viewed from the side, the tines 26 are arranged in a star-like configuration with equal angular distance between the tines 26. The tines 26 have an inner part 28 extending radially from the shaft 24 and an outer part 30 extending almost tangentially, there being a smooth transition between the inner and the outer parts 28, 30. A blade 29 is mounted at the tip of each tine 26. The tines 26 arranged star-like on the shaft 24 look like a paddle wheel 32. As shown in FIG. 2, shaft 24 carries three such paddle wheels 32. The outer parts 30 of the tines 26 is extend through about 30°.

When a respective one of the parcels 10 has been moved along the conveyor 16 to the location of the separating device 22, the tip of an outer part 30 of a respective tine 26 enters the parcel 10 at a location 34 towards the forward end, in a direction substantially parallel to the layering so as to penetrate behind a layer 36. The shaft 24 is positioned at a height above the upper side of the parcel 10 such that the line from the entering location 34 to the axis of the shaft 24 forms an angle of between 14° and 24° the horizontal. The tip of the outer part 30 of the tines 26 forms about the same angle with the circumference of the paddle wheel 32 so that they enter the parcel 10 in a substantially vertical direction, i.e. a direction parallel to the layering in the tobacco parcel 10.

In order to separate the layer 36 from the parcel 10, the peripheral velocity of the paddle wheels 32 is about three to five times the movement velocity of the parcel 10, i.e. the velocity of the conveyor 16. This velocity ratio is important for separating the layer 36 from the rest of the parcel 10. While the tip of the outer part 30 accelerates the separated layer 36, the back of the tine 26 moves coincident with the front face of the rest of the parcel 10 without interfering. The back of the tine 26 is shaped so that it follows the horizontal movement of the tobacco parcel 10. This means that the point of contact between the back of the tine 26 and the front face of the parcel 10 moves in horizontal direction at about the velocity of the conveyor 16. The back of the outer part 30 and the transition between the outer part 30 and the inner part 28 of the tines 26 are shaped to meet this uniformity of velocities for a considerable time period so as to allow for tobacco parcel's stability and to avoid disturbing forces being exerted on the tobacco parcel 10.

Figure 3:
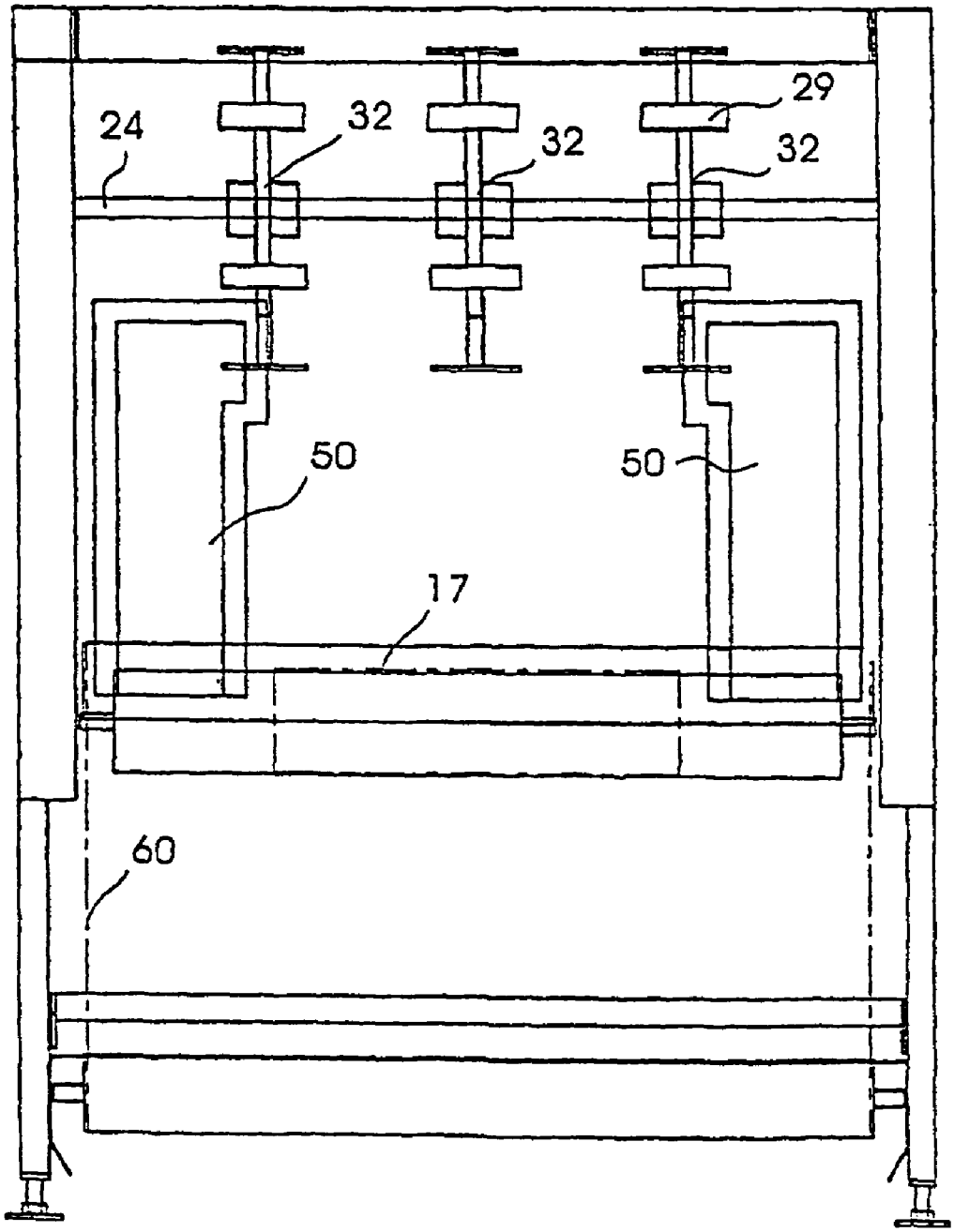
FIG. 3 is a rear view of the apparatus of FIG. 1.
Figure 4:
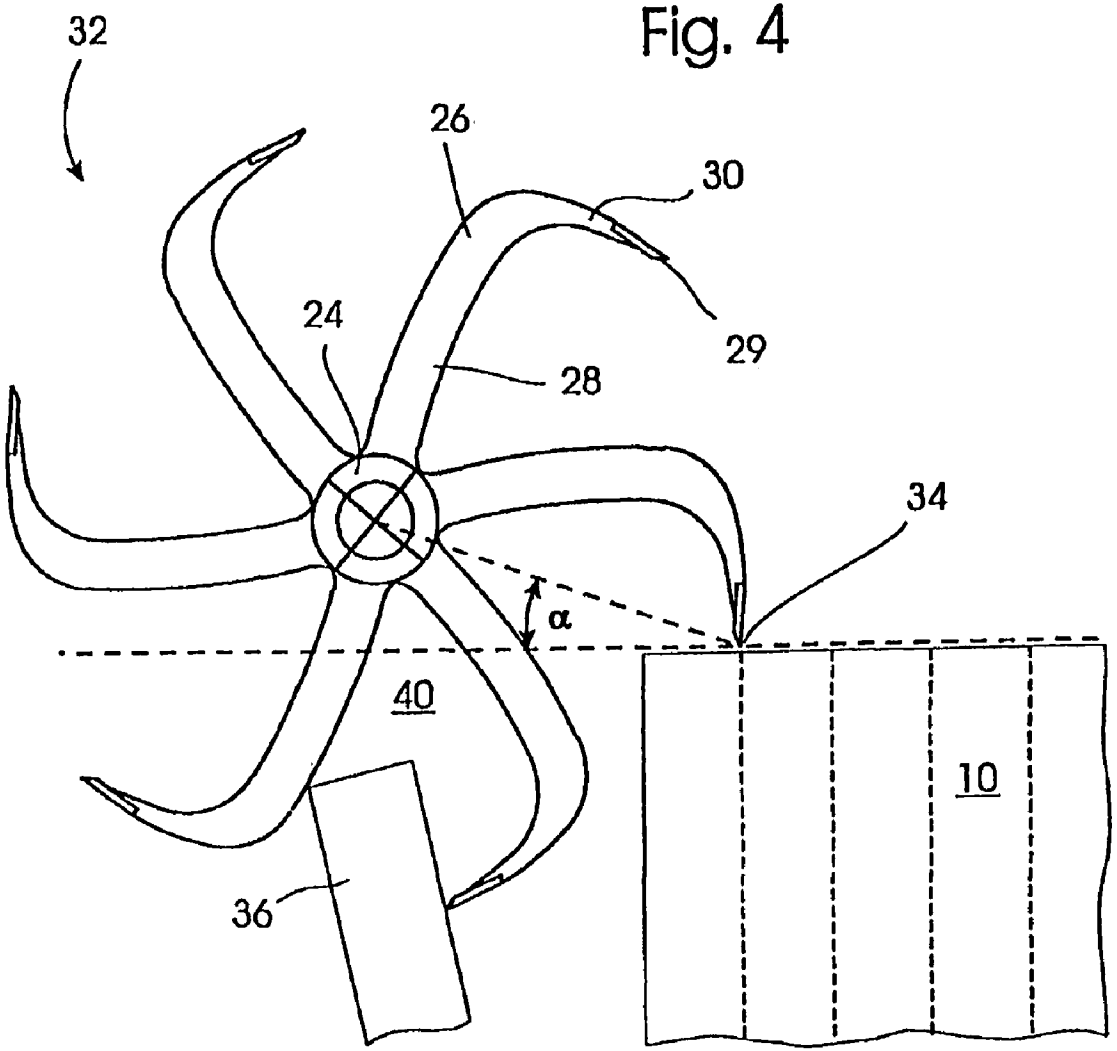
FIG. 4 is a side view of the paddle wheel.
Figure 5:
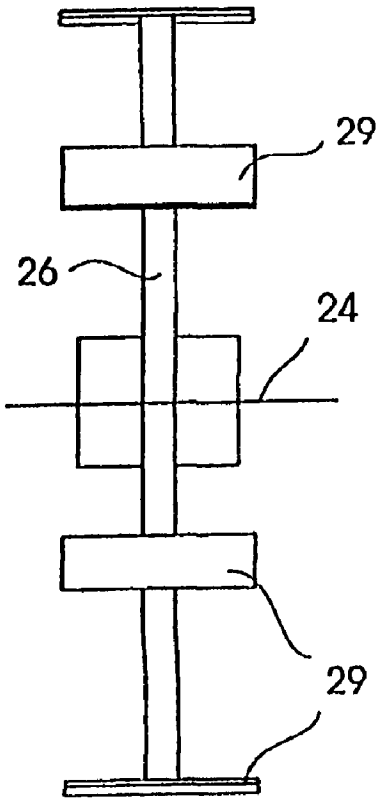
FIG. 5 is a front view of the paddle wheel.

In the embodiment of FIGS. 1 to 3, the tip of the tines 26 have a distance of 25 to 45 cm from the axis of the shaft 24. As mentioned above, the line from the tip of the tine 26 forms an angle $\alpha$ between 18° and 21° with the horizontal (FIG. 4). As a consequence of that, the tine 26 penetrates a maximum of about 70% of its radial length into the parcel 10. The position of the shaft 24 is adjustable so that it can be adapted to the vertical dimension of the parcel 10. The actual height of each parcel 10 is measured by a vision system 38 before processing the parcel 10 and the vertical position of the shaft 24 is adjusted in accordance therewith. As only one tobacco parcel 10 is processed at a time, the software may be used not only to position the tine 26 in the "parked" position and also adjust the vertical position of the shaft 24 to ensure optimal delamination but also the tine rotation speed to adjust the speed to ensure the desired number of delaminations required which may vary by tobacco type. The parcel length is measured and the speed of the conveyor and of the paddle wheel are adjusted so that the last slice has the same thickness as the other slices or up to 10% less.

In order not to crush the edge portion of the layer 36 to be separated, a sufficient angular distance between successive tines 26 is provided, pockets 40 formed between successive tines 26. The pockets 40 have a dimension l in the direction of parcel movement and at the height of the tobacco parcel 10 at least as large as the thickness t of the slice or layer 36 to be delaminated. The diameter of the hub of the shaft 24 must, of course, not be so large as to interfere with the tobacco parcel 10.

The radius of the paddle wheels 32, the number of tines 26 and the number of paddle wheels 32 depend on the type of tobacco parcel 10 to be delaminated.

Four typical designs of paddle wheels will be explained subsequently:

1. A paddle wheel 32 with three tines 26 and a radius of 450 mm, two of such paddle wheels being provided on the shaft 24, can be used for a delaminater having a capacity of about 10,000 kg/hr and up to 20,000 kg/hr. That delaminator is adapted particularly for hogsheads and C-48 parcels. The penetration depth has to be greater than the slice width to achieve the natural delaminating.
2. A paddle 32 with four tines 26 having a radius of 400 mm has a capacity of 6,000 to 12,000 kg/hr for C-48 parcels.
3. A paddle wheel 32 with six tines and a radius of 300 mm. A delaminator with such a paddle wheel 32 has a capacity of 3,000 to 8,000 kg/hr and can be used for C-48 parcels and oriental bales. The tine penetration depth is 200 mm for C-48 parcels and 50 mm for oriental bales. Two of such paddle wheels are used for oriental bales and three paddle wheels are used for C-48 parcels.
4. A paddle wheel 32 with eight tines 26 and a radius of 250 mm has capacity of 1,000 to 5,000 kg/hr for oriental bales.

The tipper unit 18 at the inlet end of the conveyor 16 comprises two flaps 50, which are arranged at both sides of the belt 17 of the conveyor 16. The flaps 50 can be swivelled from a horizontal position in which they are coplanar with the belt 17 to a vertical position. The length of the flaps 50 corresponds to the height of a C-48 parcel 10 (about 0.7 meter) and their swivelled axis access is arranged at about that distance from the inlet end of the conveyor 16. A C-48 parcel 10 can, therefore, be placed at the inlet end of the conveyor 16 with the layering in horizontal direction and can be tipped 90° by the flaps 50 so that the layering is vertical and the parcel 10 can be delaminated by the delaminating apparatus of the invention.

A chute (not shown) may be provided for at the inlet end of the conveyor 16 for collecting loose tobacco and for directing such loose tobacco onto a collecting conveyor 60 which is arranged below the conveyor 16 and conveys the loose tobacco to the outlet end of the conveyor means 14.

Figure 6:
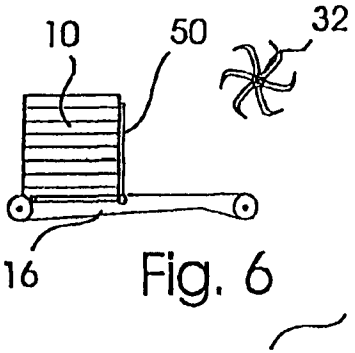
FIGS. 6 to 17 show the sequences of the delaminating.
Figure 7:
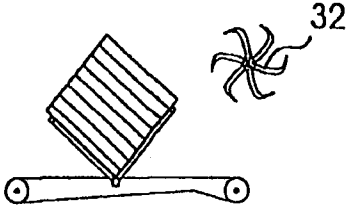
Figure 8:
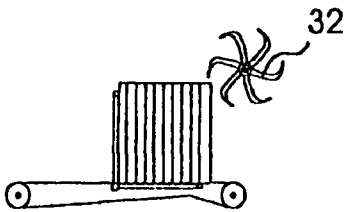
Figure 9:
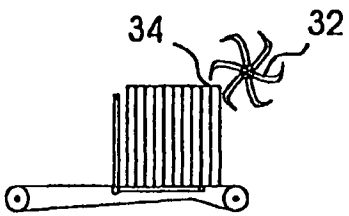
Figure 10:
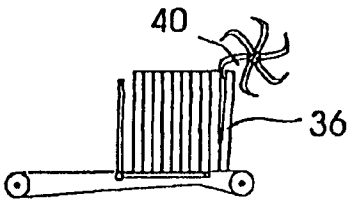
Figure 11:
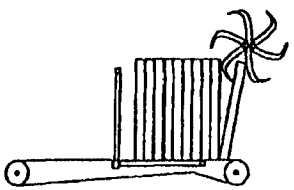
Figure 12:
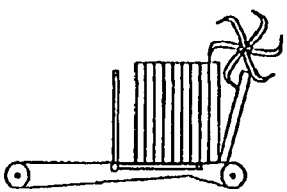
Figure 13:
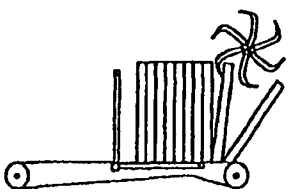
Figure 14:
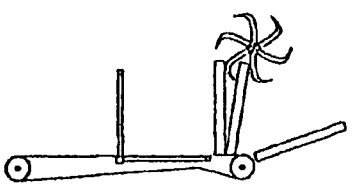
Figure 15:
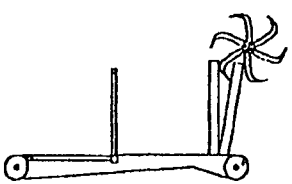
Figure 16:
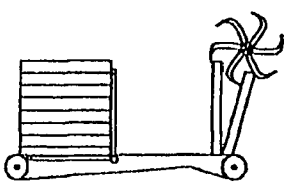
Figure 17:
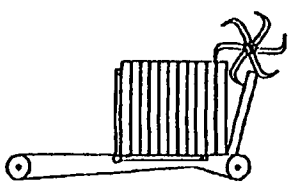

A typical sequence of process steps is shown in FIGS. 6 to 17: A C-48 tobacco parcel 10 delivered at the inlet end of the conveyor 16 with horizontal layering is tipped 90 degrees such that the layering is vertical (FIGS. 6 to 8). After the parcel 10 is tipped the actual height is measured and the vertical position of the shaft 24 is adjusted for the angle $\alpha$ to be 16°. The paddle wheel 32 is shown in the "parked" position in FIGS. 8 and 9. The paddle wheel 32 is of the above-mentioned typical design No. 2 and starts rotating as soon as the forward end of the parcel 10 has passed over the separating location 20 by a distance equal to the intended thickness of the layer or slice 36 (FIG. 10). Further rotation of the paddle wheel 32 prises off the layer 36, the upper portion of the layer being held in the pocket 40 between the tine 26 which has separated this layer and the preceding tine 26. The backward part of the tine 26 is shaped such that the upper edge of the layer 36 when tipping forward slides along the back of the tine Without substantial pressure (FIGS. 11 and 12). Layer 36 is freed from the pocket and the next layer is prised off with further rotation of the paddle wheel 32 (FIG. 13). Delamination is continued in this manner throughout the whole length of the parcel 10. The axis of the tipper unit 18 is arranged at a distance from the separating location which is greater than the length of the parcel 10 by at least the thickness of one layer 36, this length being measured normal to the layering. The tipper unit 18 can, therefore, be swivelled back to the inlet end of the conveyor 16 while the last two layers 36 are being separated (FIGS. 14 and 15). The subsequent parcel 10 is received and tipped forward while the last layer 36 is held in the pocket 40 (FIGS. 16 and 17).

List of Reference Numerals

10 parcel
14 conveyor means
16 conveyor
17 belt
18 tipper unit
20 separating location
22 separating device
24 shaft
26 tines
28 inner part
29 blade
30 outer part
32 paddle wheel
34 location
36 layer
38 vision system
40 pocket
50 flap
60 collecting conveyor

The invention claimed is:

1. Apparatus for delaminating tobacco in the form of slices from a layered parcel, comprising:

conveyor means for delivering a parcel of tobacco to a separating location, and a rotatable tine assembly mounted on an axis extending at a right angle to a direction of movement of the conveyor means and parallel to the layering of the parcel, the rotatable tine assembly having a plurality of axially spaced apart paddle wheels, and wherein each paddle wheel includes a plurality of tines which are pointed and profiled to extend in the direction of rotation of the tine assembly and are driven at a speed greater than that of the conveyor means, each of the tines having an inner part extending radially from the shaft and an outer part extending approximately tangentially to the direction of rotation of the tine assembly, such that the tines enter the parcel at an entering location in a direction substantially parallel to the layering of the parcel, and wherein a tip of each tine when entering the parcel has a horizontal component, which coincides with a horizontal movement of the parcel, and as the rotation of the tine assembly continues, the tines accelerate a layer away from the parcel for effecting separation of the layer of tobacco from the parcel, characterized in that the axis of the tine assembly is arranged at a distance above the parcel such that the line from the axis of the tine assembly to the entering location forms an angle between 14 and 24° with the horizontal and in that the peripheral speed of the tine assembly is about three to five times the linear speed of the conveyor means during separation of the layer of tobacco from the parcel.

2. Apparatus according to claim 1, characterized in that the line from the axis of the tine assembly to the entering location forms an angle of about 16°.

3. Apparatus according to claim 1, characterized in that a pocket is formed between each two successive tines of each paddle wheel and in that the number of tines and the ratio between the peripheral speed of the tine assembly and the linear speed of the conveyor means are chosen such that the portion of the slices extending into the pocket is not crushed or substantially deformed.

4. Apparatus according to claim 1, characterized in that the conveyor means end at the separating location and that the rotatable tine assembly is mounted vertically above the separating location.

5. Apparatus according to claim 1, characterized in that means are provided for tipping a parcel of tobacco onto the conveyor means so that the layering is generally at right angles to the conveyor means.

6. Method of delaminating tobacco in the form of slices from a layered parcel, comprising the following steps:

delivering a parcel of tobacco to a separating location, and driving a rotatable tine assembly at a speed greater than that of a conveyor means, the tine assembly being mounted on an axis extending at a right angle to the conveyor means and parallel to the layering of the parcel, the rotatable tine assembly having a plurality of axially spaced apart paddle wheels, wherein each paddle wheel includes a plurality of tines which are pointed and profiled to at least partly extend in the direction of rotation of the tine assembly, the tines having an inner part extending radially from the shaft and an outer part extending approximately tangentially, such that the tines enter the parcel in a direction substantially parallel to the layering of the parcel, and wherein a tip of each tine when entering the parcel has a horizontal component, which coincides with a horizontal movement of the parcel and as the rotation of the tine assembly continues, the tines accelerate a layer away from the parcel for effecting separation of the layer of tobacco from the parcel, characterized by arranging the axis of the tine assembly at a distance above the parcel such that the line from the axis of tine assembly to the points of the tines includes an angle between 14 and 24° with the horizontal and by driving the tine assembly at a peripheral speed, wherein during separation of the layer of tobacco from the parcel the peripheral speed of the tines is about three to five times the linear speed of the conveyor means.

7. Method according to claim 6, characterized by forming a pocket between each two successive tines of each paddle wheel and by choosing the number of tines and the ratio between the peripheral speed of the tine assembly and the linear speed of the conveyor means such that the portion of the slices extending into the pocket is not crushed or substantially deformed.

8. An apparatus for delaminating tobacco in the form of slices from a layered parcel, comprising:

a conveyor operable to deliver a parcel of tobacco to a separating location, and a rotatable tine assembly mounted on an axis extending orthogonally to the conveyor and parallel the layering of the parcel, the rotatable tine assembly having a plurality of axially spaced apart paddle wheels, and wherein each paddle wheel includes a plurality of tines which are pointed and profiled to extend in the direction of rotation of the tine assembly, the tines enter the parcel at an entering location in a direction substantially parallel to the layering of the parcel, and wherein a tip of each tine when entering the parcel has a horizontal component, which coincides with a horizontal movement of the parcel, and as the rotation of the tine assembly continues, the tines accelerate a layer away from the parcel for effecting separation of the layer of tobacco from the parcel, the axis of the tine assembly being arranged at a distance above the parcel such that the line from the axis of the tine assembly to the entering location forms an angle between 14 and 24° with the horizontal and the peripheral speed of the tine assembly is about three to five times the linear speed of the conveyor during separation of the layer of tobacco from the parcel.

9. The apparatus according to claim 8, wherein the line from the axis of the tine assembly to the entering location forms an angle of about 16°.

10. The apparatus according to claim 8, wherein a pocket is located between each two successive tines of each paddle wheel and the number of tines and the ratio between the peripheral speed of the tine assembly and the linear speed of the conveyor are adjusted such that the portion of the slices extending into the pocket is not crushed or substantially deformed.

11. The apparatus according to claim 8, wherein the conveyor ends at the separating location and the rotatable tine assembly is mounted vertically above the separating location.

12. The apparatus according to claim 8, further comprising an apparatus operable to orient a parcel of tobacco onto the conveyor so that the layering is generally at right angles to the conveyor.

13. A method of delaminating tobacco in the form of slices from a layered parcel, comprising:

delivering a parcel of tobacco on a conveyor to a separating location, and driving a rotatable tine assembly at a speed greater than that of the conveyor, the tine assembly being mounted on an axis extending parallel to the conveyor, the rotatable tine assembly having a plurality of axially spaced apart paddle wheels, and wherein each paddle wheel includes a plurality of tines which are pointed and profiled to at least partly extend in the direction of rotation of the tine assembly, the tines enter the parcel in a direction substantially parallel to the layering of the parcel, and wherein a tip of each tine when entering the parcel has a horizontal component, which coincides with a horizontal movement of the parcel, and as the rotation of the tine assembly continues, the tines accelerate a layer away from the parcel for effecting separation of the layer of tobacco from the parcel, the axis of the tine assembly being located a distance above the parcel such that the line from the axis of tine assembly to the points of the tines includes an angle between 14 and 24° with the horizontal and the tine assembly being driven at a peripheral speed of about three to five times the linear speed of the conveyor during separation of the layer of tobacco from the parcel.

14. The method according to claim 13, further comprising maintaining the speed of the conveyor and/or the tine assembly such that a portion of the slices extending into the pocket between two successive tines of each paddle wheel is not crushed or substantially deformed.

15. The apparatus according to claim 8, wherein the tines having an inner part extending radially from the axis and an outer part extending tangentially.

16. The apparatus according to claim 8, further comprising a blade attached to the tip of the outer part of each tine.

17. The apparatus according to claim 16, wherein the blade has a width of about 100 to 200 mm in an axial direction.

18. The apparatus according to claim 16, wherein the blade attached to the tip of each tine has a height of about 50 mm.

19. The apparatus according to claim 16, wherein a cumulative width of the blades is 20 to 50 percent of a width of the parcel.

20. The apparatus according to claim 8, wherein the axis of the tine assembly is adjustable.

21. The apparatus according to claim 20, further comprising a vision system for measuring a height of the layered parcel, and wherein the axis of the tine assembly is adjustable in accordance therewith.

22. The apparatus according to claim 1, wherein the linear speed of the conveyor means and the speed of the paddle wheels are adjusted such that a last slice has a same thickness as the other slices or up to 10% less.

23. The method according to claim 6, further comprising adjusting the linear speed of the conveyor means and the speed of the paddle wheels such that a last slice has a same thickness as the other slices or up to 10% less.

* * * * *

UNITED STATES PATENT AND TRADEMARK OFFICE

CERTIFICATE OF CORRECTION

PATENT NO. : 7,810,506 B2
APPLICATION NO. : 10/476301
DATED : October 12, 2010
INVENTOR(S) : Carlos Munoz et al.

It is certified that error appears in the above-identified patent and that said Letters Patent is hereby corrected as shown below:

On the title page, under U.S. Patent Documents, item [56] the following should be deleted:

| | | | |
|---|---|---|---|
| "4,361,749 | A | 11/1982 | Lord |
| 4,565,601 | A | 1/1986 | Kakehi et al. |
| 4,971,653 | A | 11/1990 | Powell et al. |
| 5,186,238 | A | 2/1993 | Del Puerto et al. |
| 5,192,849 | A | 3/1993 | Moslehi |
| 5,835,334 | A | 11/1998 | Barnes et al. |
| 6,392,205 | B1 | 5/2002 | Minonishi" |

On the title page, under Foreign Patent Documents, item [56] the following should be deleted:

| | | | |
|---|---|---|---|
| "EP | 0357424 | A | 3/1990 |
| JP | 59136930 | A | 8/1984 |
| JP | 59175727 | A | 10/1984 |
| JP | 60206050 | A | 10/1985 |
| JP | 02146728 | A | 6/1990 |
| JP | 03190125 | A | 8/1991 |
| JP | 07130830 | A | 5/1995 |
| JP | 09036097 | A | 2/1997 |
| WO | 01/24581 | A | 4/2001" |

On the title page, under Other Publications, the following should be deleted:

"Notification of Transmittal of the International Search Report and the Written Opinion of the International Searching Authority or the Declaration for PCT/US2004/009626 dated April 14, 2005"

Signed and Sealed this

Seventh Day of December, 2010

David J. Kappos

David J. Kappos
*Director of the United States Patent and Trademark Office*